United States Patent [19]

Archambault

[11] 4,225,132

[45] Sep. 30, 1980

[54] EXERCISE EQUIPMENT HAVING DETACHABLE SPRING ASSEMBLY AND FOLDABLE CARRYING HANDLE

[75] Inventor: Larry J. Archambault, Ridgefield Park, N.J.

[73] Assignees: William Gunner, Pompton Plains; Susan Leiken, Ridgefield Park, both of N.J. ; part interest to each

[21] Appl. No.: 28,496

[22] Filed: Apr. 9, 1979

[51] Int. Cl.[3] ..... A63B 21/02

[52] U.S. Cl. ..... 272/137; 272/142; 272/143; 272/127

[58] Field of Search ..... 272/137, 142, 122, 123, 272/135, 143, DIG. 4

[56] References Cited

U.S. PATENT DOCUMENTS

| | | | |
|---|---|---|---|
| 2,131,570 | 9/1938 | Riley | 272/123 X |
| 3,460,829 | 8/1969 | Roggero | 272/142 X |
| 3,592,467 | 7/1971 | Pereira | 272/137 |

*Primary Examiner*—Richard C. Pinkham
*Assistant Examiner*—William R. Browne
*Attorney, Agent, or Firm*—Donald R. Heiner

[57] ABSTRACT

A piece of portable exercise equipment having essentially two axle and wheel assemblies wherein each axle and wheel assembly has a hollow cylinder, a threaded rod extending through the cylinder, two wheels with nuts for securing the wheels to the threaded rod, and, an "S" shaped hook disposed about each end of the axle. A spring assembly having swivel snaps, a carrying handle, a hitch attaching the carrying handle and springs, a pin for retaining the springs in the hitch, springs and handle bars, is disposed between the two axle-wheel assemblies and can be connected to either end of the axle-wheel assembly by means of the swivel snaps and "S" hooks.

The assembly consisting of the hollow wooden handle, threaded rod, "S" hook wheel, and cap nut, can be used by itself as a piece of exercise equipment, or, the complete assembly can be used for a piece of exercise equipment.

4 Claims, 4 Drawing Figures

EXERCISE EQUIPMENT HAVING DETACHABLE SPRING ASSEMBLY AND FOLDABLE CARRYING HANDLE

BACKGROUND OF THE INVENTION

The present invention relates generally to the field of exercise equipment and more particularly to the field of portable exercise equipment for strengthening arms, chest, back, stomach and abdominal muscles. The equipment can be rolled into one (1) compact unit for carrying or storage.

The equipment basically comprises two (2) separate assemblies which can be joined together by means of swivel snaps to form one (1) piece of exercise equipment.

One (1) unit comprises a hollow handle having a threaded rod extending there through, a plurality of "S" shaped hooks for securing this unit to the swivel snaps, a pair of wheels secured to the threaded rod, and, a pair of cap nuts for holding the wheels on the threaded rod.

The second unit comprises a carrying handle, a hitch for attaching the carrying handle to a plurality of springs, a pin slidably engaging the hitch for retaining the springs in the hitch, and, a pair of handle bars.

This second unit can be secured to the first unit by means of swivel snaps.

With the exercise equipment in this assembled condition the two (2) axle-wheel assemblies can be rolled towards each other over the springs and the carrying handles can be folded towards each other to form a convenient carrying device thus making the equipment portable.

SUMMARY OF THE INVENTION

Briefly, the invention relates to portable exercise equipment comprising essentially two (2) separate units which can be used individually or which can be connected together to form one (1) piece of exercise equipment which equipment would then be portable.

One (1) unit comprises two (2) axle and wheel assemblies each comprising a hollow cylinder having a threaded rod extending through the cylinder. Two (2) wheels with cap nuts for securing the wheels to the threaded rod, and, and "S" shaped hook are disposed about each end of the axle.

The second or spring unit comprises a carrying handle having a slit formed therein, a pair of spaced apart handle bars, a pair of hitches for securing the springs and carrying handle together, a plurality of springs extending from one (1) hitch to the other, and, a pair of pins for retaining the springs in the hitch.

A plurality of swivel snaps are provided for securing the first unit to the second.

With the equipment thus fully assembled, the two (2) axle-wheel assemblies can be rolled towards each other over the springs and the carrying handles assembled can be folded towards each other to form a convenient carrying device.

Accordingly, it is an object of the invention to provide a piece of portable exercise equipment.

Another object of the invention is to provide a portable exercise equipment comprising essentially two (2) separate units which can be secured together to form one (1) piece of exercise equipment.

Another object of the invention is to provide two (2) separate pieces of exercise equipment which can be secured together and rolled into one (1) piece of exercise equipment which then becomes portable.

Another object of the invention is to provide a piece of portable exercise equipment having a pair of adapters which can be threadably rotated on to a threaded rod for convenience.

These and other objects and advantages of the invention are believed made clear by the following description thereof taken in conjunction with the accompanying drawings wherein;

IN THE DRAWINGS

DESCRIPTION OF THE PREFERRED EMBODIMENT

Figure 1:
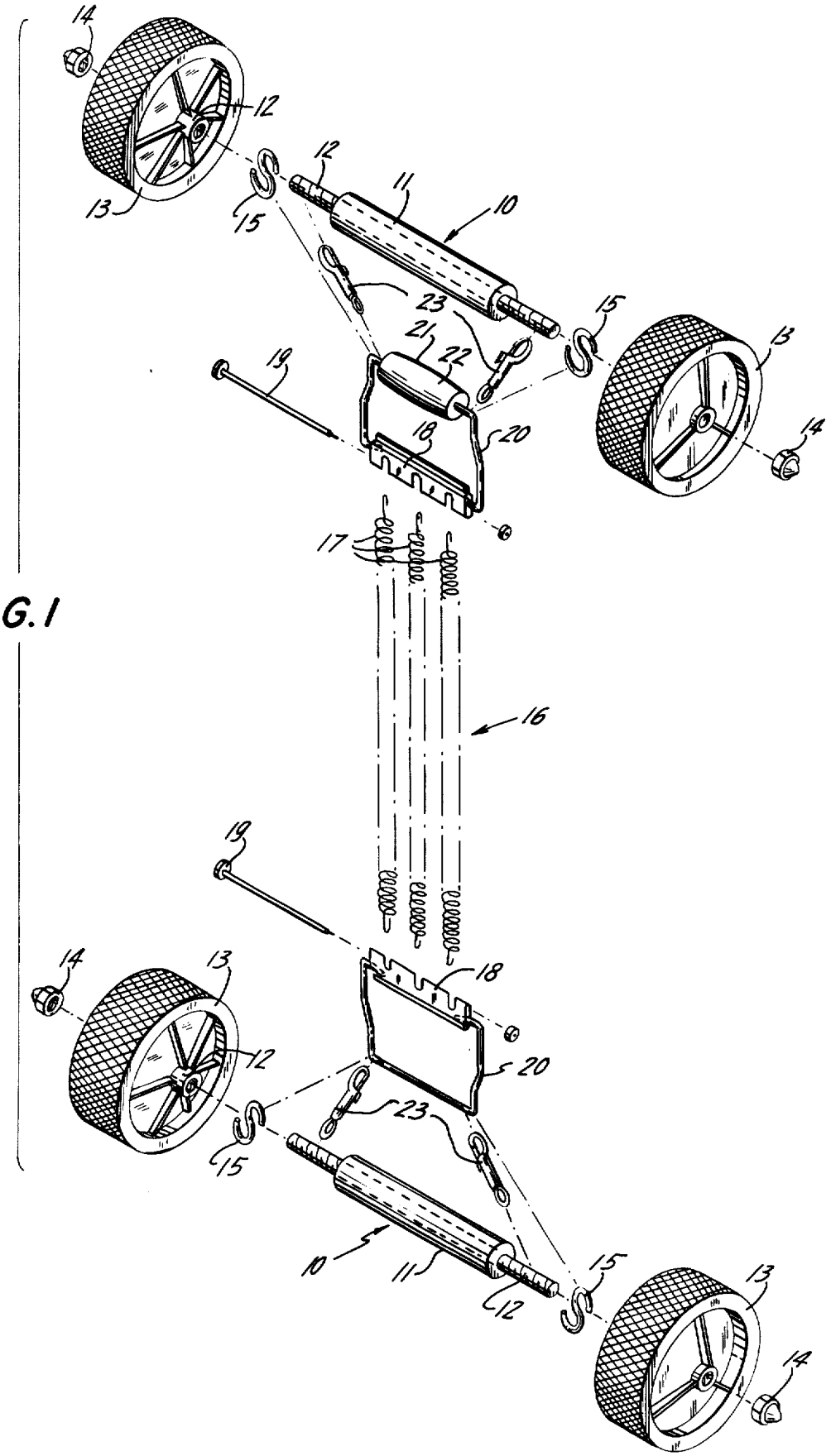
FIG. 1 is an exploded-perspective view of the equipment in an unassembled condition.

The portable exercise equipment comprises two (2) sets of axle-wheel assemblies 10 wherein each axle-wheel assembly comprises an axle 11 having a threaded rod 12 extending there through, a pair of wheels 13 for slidably engaging the threaded rod 12, and, a pair of cap nuts 14 threadably engaging threaded rod 12 for securing wheels 13 to the rod. Further, a pair of "S" hooks 15 are operatively associated with each end of the threaded rod for connecting the axle-wheel assembly to a spring assembly as will be morefully described below.

The spring assembly is disposed between the two (2) spaced apart axle-wheel assemblies and is generally indicated at 16.

The spring assembly comprises a plurality of spring members 17 each of which are secured at each end to a hitch 18 by means of retaining pins 19. Fastened to each hitch 18 is a handle bar 20 and a carrying handle 21 having a slit 22 formed therein is disposed about one handle bar 20 only. When the handle bar 20 without the carrying handle 21 is folded towards the handle bar comprising the carrying handle 21, it snaps into slit 22 thus forming a convenient carrying handle for the entire assembly.

Also associated with each handle bar 20 is a plurality of swivel snaps 23 for securing each of said handle bars 20 to "S" hooks 15 when it is desired to completely assemble the unit.

Figure 2:
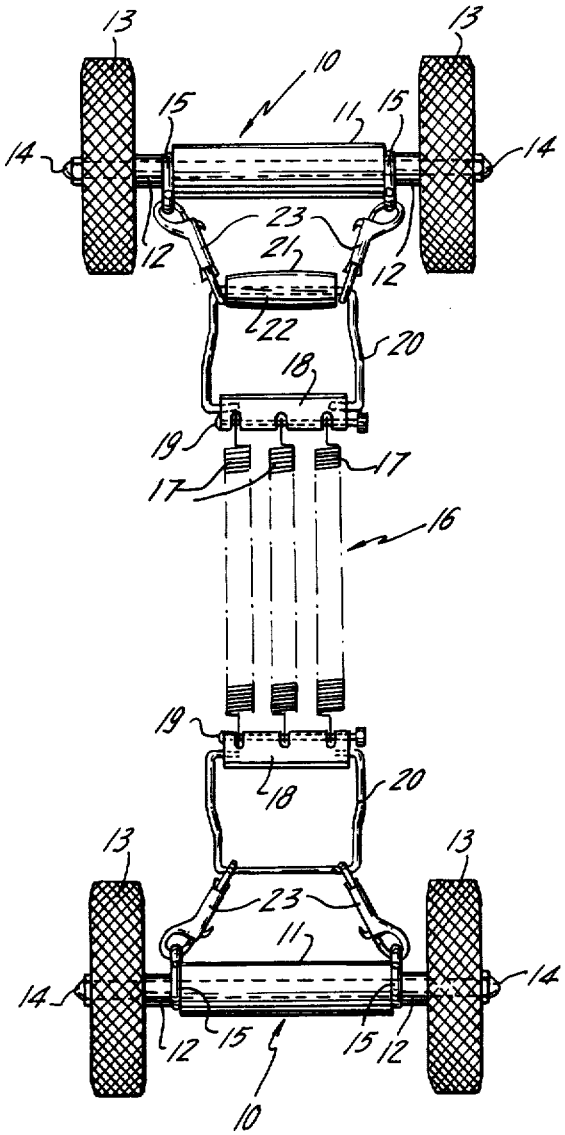
FIG. 2 is a plan view of the equipment in an assembled condition.
Figure 3:
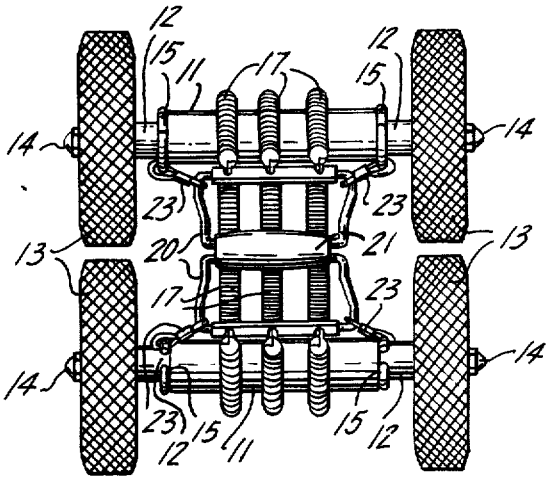
FIG. 3 is a plan view of the equipment in an assembled condition and with the unit rolled into a carrying position; and, FIG. 4 is a side view of an adapter.

FIG. 2 discloses the exercise equipment in a completely assembled condition and FIG. 3 discloses the two axle-wheel assemblies rolled towards each other over the spring assembly 16 with one (1) handle bar 20 snapped into slit 22 of carrying handle 21 for portability and ease of carrying.

Figure 4:
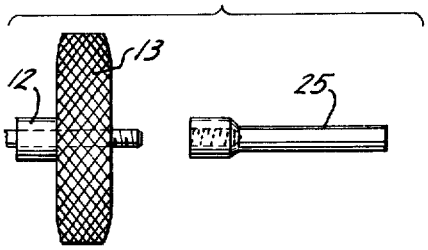

FIG. 4 discloses and adapter 24 several inches in length having an end piece 25 operatively associated therewith wherein the end piece has internal threads. With cap nuts 24 removed adapter 25 can be threadably engaged on threaded rods 12 to increase the number of exercise possibilities such as exercises for the legs and 2-arm curls.

With the portable exercise equipment completely assembled as one unit as shown in FIG. 2, that is, with the spring assembly 16 attached to the axle-wheel assembly 10 by means of "S" hooks 15 and swivel snaps 23, the device can be used for several stretching exercises, chest pulls, back pulls, forward and reverse curls, etc., etc.

By detaching the spring assembly 16 from the axle-wheel assembly 10 by releasing the swivel snaps 23 from "S" hooks 15, the two axle-wheel assemblies can be used for a number of rolling floor exercises such as rolling the wheels forward with one in each hand, rolling the wheels laterally as in a push-up position etc.

With the cap nuts 14 removed and the adapter 24 threadably engaging the rod 12 the axle-wheel assemblies can be utilized for leg and lower back exercises as well as 2-arm curls.

When it is again desired to completely assemble the unit for portability and ease of carrying, the swivel snaps 23 are connected to the "S" hooks 15 and the two axle-wheel assemblies are rolled towards each other over the spring assembly 16 until they line up as shown in FIG. 3. The one handle bar 20 is now pushed through slit 22 in carrying handle 21 so that the entire unit can be picked up by means of carrying handle 21 as shown in FIG. 3.

Thus, what has been described is a unique piece of portable exercise equipment comprising two separate assemblies which can readily be separated from each other, and, which, when fully assembled can be easily carried.

One assembly comprises an axle having a threaded rod extending there through, a pair of wheels disposed on each end of the threaded rod, cap nuts for securing the wheels to the threaded rod, and, a pair of "S" hooks.

The other assembly comprises a plurality of springs the ends of which are each secured in a hitch by means of a pin. Operatively associated with each hitch is a handle bar and one of the handle bars has a carrying handle having a slit formed therein or receiving the other handle bar.

Finally, each handle bar has a pair of swivel snaps connected thereto for connecting this spring assembly to the axle-wheel assembly when desired.

It is to be understood that the invention is not to be restricted to the parts shown but they may be widely varied within the invention as claimed.

What is claimed is:

1. Portable exercise equipment comprising:

(a) two axle-wheel assemblies;

(b) two "S" hooks connected to each of said axle-wheel assemblies;

(c) a spring assembly disposed between the said two axle wheel assemblies comprising a plurality of spring members, a pair of hitches disposed at each end of said spring members, a pair of retaining pins operatively associated with said hitches for securing said spring members to said hitches, a handle bar connected to each of said hitches, and, a carrying handle connected to one of said handle bars and having a slit formed therein whereby when the other handle bar is folded toward said carrying handle it snaps into said slit forming a carrying handle for the portable exercise equipment; and, (d) two swivel snaps connected to each end of said spring assembly whereby said spring assembly can be connected to said axle-wheel assemblies by means of said "S" hooks.

2. The portable exercise equipment of claim 1 wherein said axle-wheel assemblies each comprise:

(a) an axle;

(b) a threaded rod extending through said axle;

(c) a pair of wheels slidably engaging said threaded rod at each end thereof; and, (d) a pair of cap nuts threadably engaging said threaded rod on each end thereof for securing said wheels on said threaded rod.

3. The portable exercise equipment of claim 2 wherein an adapter having an end piece having internal threads formed therein threadably engages each end of said threaded rod to provide an arm or leg hold.

4. The portable exercise equipment of claim 3 wherein said spring assembly comprises:

(a) a plurality of spring members;

(b) a pair of hitches disposed at each end of said spring members;

(c) a pair of retaining pins operatively associated with said hitches for securing said spring members to said hitches;

(d) a handle bar connected to each of said hitches; and, (e) a carrying handle connected to one of said handle bars and having a slit formed therein whereby when the other handle bar is folded toward said carrying handle it snaps into said slit forming a carrying handle for the portable exercise equipment.

* * * * *